US006206079B1

(12) United States Patent
Selgrad

(10) Patent No.: US 6,206,079 B1
(45) Date of Patent: Mar. 27, 2001

(54) CURTAIN BARRIER ASSEMBLY

(75) Inventor: Robert Wayne Selgrad, Glenview, IL (US)

(73) Assignee: Industrial Noise Control, Inc., Addison, IL (US)

( * ) Notice: Subject to any disclaimer, the term of this patent is extended or adjusted under 35 U.S.C. 154(b) by 0 days.

(21) Appl. No.: 09/201,509

(22) Filed: Nov. 30, 1998

(51) Int. Cl.[7] ..... A47G 5/00
(52) U.S. Cl. ..... 160/351; 160/135
(58) Field of Search ..... 160/135, 351, 160/372, 374, 374.1, 377, 378, 381, 390, 391; 135/119, 127, 139, 143, 901; 403/109.1, 109.3, 109.8

(56) References Cited

U.S. PATENT DOCUMENTS

| | | | | |
|---|---|---|---|---|
| 158,217 | * | 12/1874 | Low | 160/351 |
| 377,732 | * | 2/1888 | Adams | 160/351 |
| 1,238,646 | * | 8/1917 | Dennis | 160/135 |
| 2,229,475 | * | 1/1941 | Redmer | 403/109.3 X |
| 2,357,819 | | 9/1944 | Greer . | |
| 2,571,382 | | 10/1951 | Raven . | |
| 2,609,043 | * | 9/1952 | Dubinsky | 160/390 |
| 2,823,744 | * | 2/1958 | Garris | 160/135 |
| 3,428,108 | | 2/1969 | Singer . | |
| 3,502,330 | | 3/1970 | Cheftel . | |
| 3,583,466 | | 6/1971 | Dreyer . | |
| 4,063,585 | | 12/1977 | Stanley . | |
| 4,085,789 | | 4/1978 | Steiner et al. . | |
| 4,134,439 | | 1/1979 | Scott . | |
| 4,465,262 | | 8/1984 | Itri et al. . | |
| 4,842,035 | | 6/1989 | Thompson . | |
| 5,414,950 | * | 5/1995 | Johnson, Sr. | 160/372 X |
| 5,501,051 | * | 3/1996 | Harlan | 160/135 X |
| 5,553,648 | * | 9/1996 | Goharjou | 160/351 X |
| 5,779,386 | * | 7/1998 | Eichorn | 403/109.3 X |

FOREIGN PATENT DOCUMENTS

| | | |
|---|---|---|
| 528142 | 10/1940 | (GB) . |
| 2 081 338 | 2/1982 | (GB) . |

OTHER PUBLICATIONS

Singer Safety Products, Inc. Catalog No. 502, published by Singer Safety Products, 1973, pp. 1–8.

Steiner Industries Catalog No. 201, published by Steiner Industries, 1985, pp. 16–19.

"Quiet Times" Information Bulletin, published by Industrial Noise Control, Inc., vol. 1, Issue 3, 1986, pp. 1–4.

"Noise Screens" published by Industrial Noise, Inc., pp. 1–4. While publication date is unknown, it is believed that the literature was available to the public prior to Nov. 30, 1998.

"Capabilities Profile" published by Industrial Noise, Inc., pp., 1–4. While the publication date is unknown, it is believed that the literature was available to the public prior to Nov. 30, 1998.

* cited by examiner

*Primary Examiner*—Bruce A. Lev
(74) *Attorney, Agent, or Firm*—Brinks Hofer Gilson & Lione

(57) ABSTRACT

A frame having a top frame piece, a bottom frame piece with a receptor, a first side frame piece attached to the top frame piece and to the bottom frame piece and a second side frame piece attached to the top frame piece and to the bottom frame piece. A foot is attached to the receptor, wherein the receptor has a structure such that the foot can be attached to the receptor only at n predetermined positions, where n is ≧2.

27 Claims, 3 Drawing Sheets

CURTAIN BARRIER ASSEMBLY

BACKGROUND OF THE INVENTION

1. Field of the Invention

The present invention relates to both a frame and a curtain barrier assembly that can be used to support such curtain barriers as welding screens and curtain barriers.

2. Discussion of Related Art

In the past, curtain barrier assemblies have used complicated attachment schemes for the frame and the curtain barrier that require tools and/or threaded fasteners. For example, U.S. Pat. No. 4,842,035 discloses an assembly 10 of a pair of space dividers, that can be used as welding screens. A screen 10 is composed of a pair of frames 11 and 12 pivotally interconnected by hinge assemblies 13. A frame 11 may include a top corner frame member 14, a bottom corner frame member 15, an interconnecting top corner frame member 16 and an interconnecting bottom corner frame member 17. The corner frame members 14, 15, 16 and 17 are attached to each other by vertical and horizontal straight tube sections 29 that are telescopically received in the outer end portions 18 and 19 of the corner frame members. The tube sections 29 are retained in the corner frame members by rotating the thumb screws 25 through a threaded nut 20 so that they engage the telescoped ends of the straight tubes 29.

The bottom frame members 15 and 17 are designed to have either leg members 31 alone or conventional platform legs 34 support the frame 11. In the latter case, the upstanding leg portion 36 of each platform leg is telescopically received in leg member 31 of each corner frame member 15. Thumb screws 25 are then threadedly advanced through weld nuts 20 to engage the leg portions 36.

Once a frame 11 or 12 is assembled, a screen material 27 is attached by ties 28 to frames 11 and 12.

The above-mentioned use of thumb screws can provide complications during assembly. For example, it is often difficult to create enough torque on the thumb screws to adequately tighten the frame members and so some type of pliers may be needed to properly tighten the thumb screws. In addition, the thumb screws often prove incapable of preventing the platform legs from moving no matter the amount of torque applied to the thumb screws.

SUMMARY OF THE INVENTION

One aspect of the present invention regards a frame having a top frame piece, a bottom frame piece with a receptor, a first side frame piece attached to the top frame piece and to the bottom frame piece and a second side frame piece attached to the top frame piece and to the bottom frame piece. A foot is attached to the receptor, wherein the receptor has a structure such that the foot can be attached to the receptor only at n predetermined positions, where n is $\geqq 2$.

A second aspect of the present invention regards a curtain barrier assembly having a frame including a top frame piece, a bottom frame piece with a receptor, a first side frame piece attached to the top frame piece and to the bottom frame piece and a second side frame piece attached to the top frame piece and to the bottom frame piece. The frame further includes a foot attached to the receptor, wherein the receptor has a structure such that the foot can be attached to the receptor only at n predetermined positions, where n is $\geqq 2$. A curtain barrier is attached to the frame, wherein the attached curtain barrier is not attached to the male member.

A third aspect of the present invention regards a curtain barrier assembly having a frame that includes a top frame piece, a bottom frame piece, a side frame piece attached to the top frame piece and to the bottom frame piece. The frame includes a male member that attaches the side frame piece and one of the top frame piece and the bottom frame piece wherein the male member has an appendage that protrudes externally from the side frame piece. A curtain barrier attached to the frame, wherein the attached curtain barrier is not attached to the male member.

A fourth aspect of the present invention regards a frame that includes a top frame piece, a bottom frame piece, a side frame piece attached to the top frame piece and to the bottom frame piece, wherein the side frame piece has an end that is telescopically received within an end of either the top frame piece or the bottom frame piece and abuts a stop portion located within the end of either the top frame piece or the bottom frame piece. A male member attaches the side frame piece and one of the top frame piece and the bottom frame piece wherein the male member has an appendage that protrudes externally from the side frame piece.

A fifth aspect of the present invention regards a curtain barrier assembly having a frame that includes a top frame piece, a bottom frame piece, a side frame piece attached to the top frame piece and to the bottom frame piece, wherein the side frame piece has an end that is telescopically received within an end of either the top frame piece or the bottom frame piece and abuts a stop portion located within the end of either the top frame piece or the bottom frame piece. The frame includes a male member that attaches the side frame piece and one of the top frame piece and the bottom frame piece wherein the male member has an appendage that protrudes externally from the first side frame piece. A curtain barrier is attached to the frame.

Each of the above aspects of the present invention provides the advantage of a simple attachment scheme for a frame and a curtain barrier assembly that does not require tools and/or threaded fasteners and yet provides an adequately attached frame and curtain barrier assembly.

Each of the above aspects of the present invention provides the advantage of an scheme for a frame and a curtain barrier assembly that does not require the use of thumb screws for either the frame or support legs while at the same time providing adequate attachment of the frame and the support legs to prevent movement.

Further advantages and details of the frame and the curtain barrier assembly according to the invention will become apparent from the ensuing description of an exemplary embodiment in conjunction with the accompanying drawings.

DESCRIPTION OF THE PREFERRED EMBODIMENT

Figure 1:
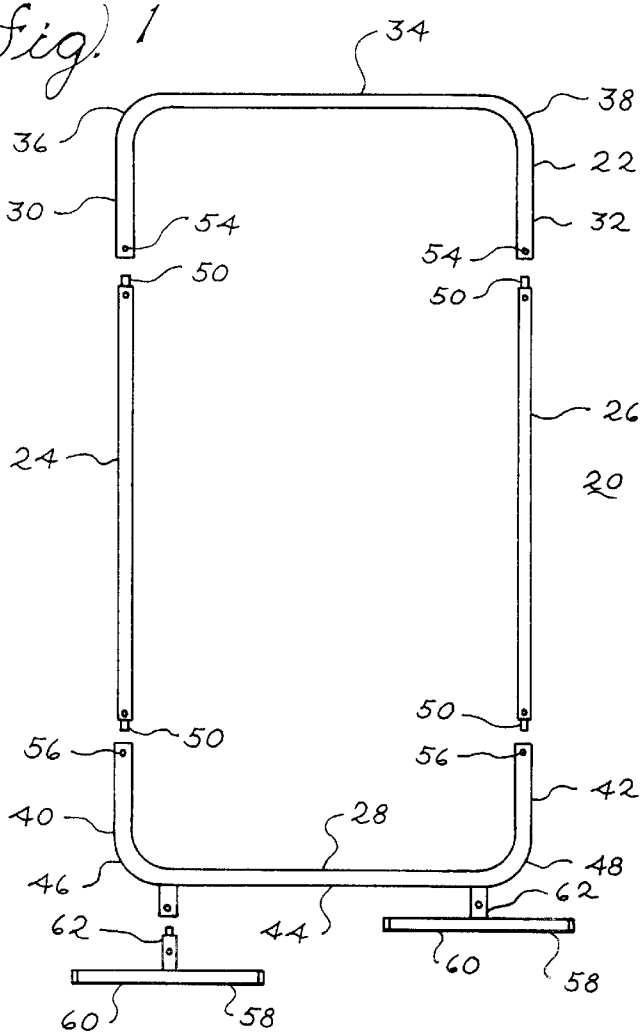
FIG. 1 is a front view of an embodiment of a frame for a curtain barrier assembly according to the present invention.
Figure 3:
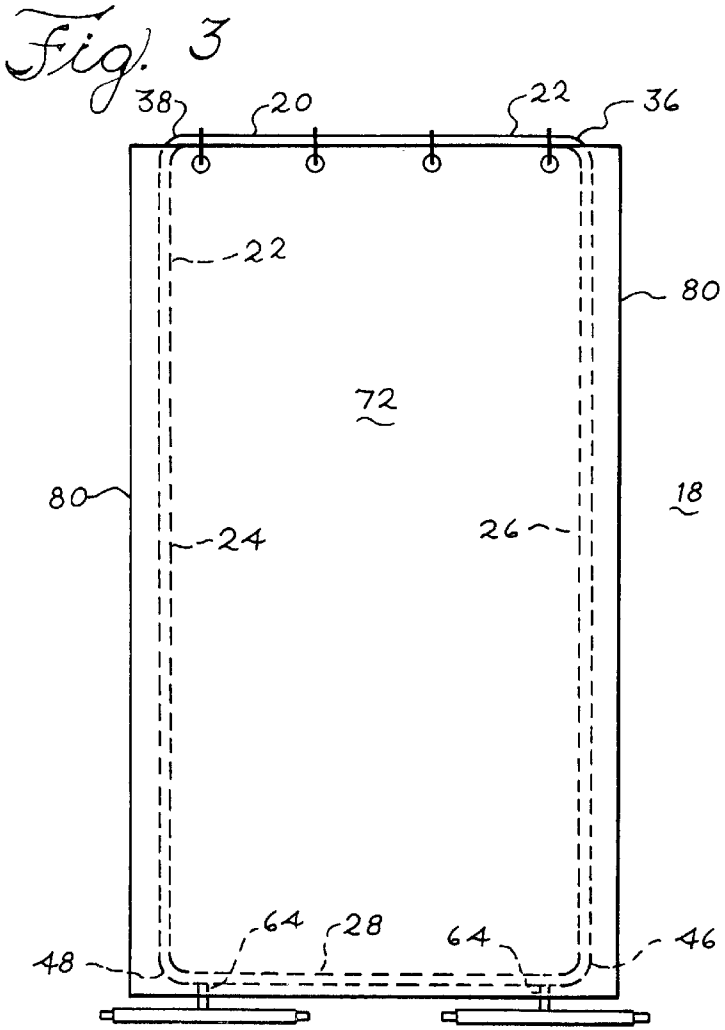
FIG. 3 is a rear view of the curtain barrier assembly of FIG. 2.
Figure 2:
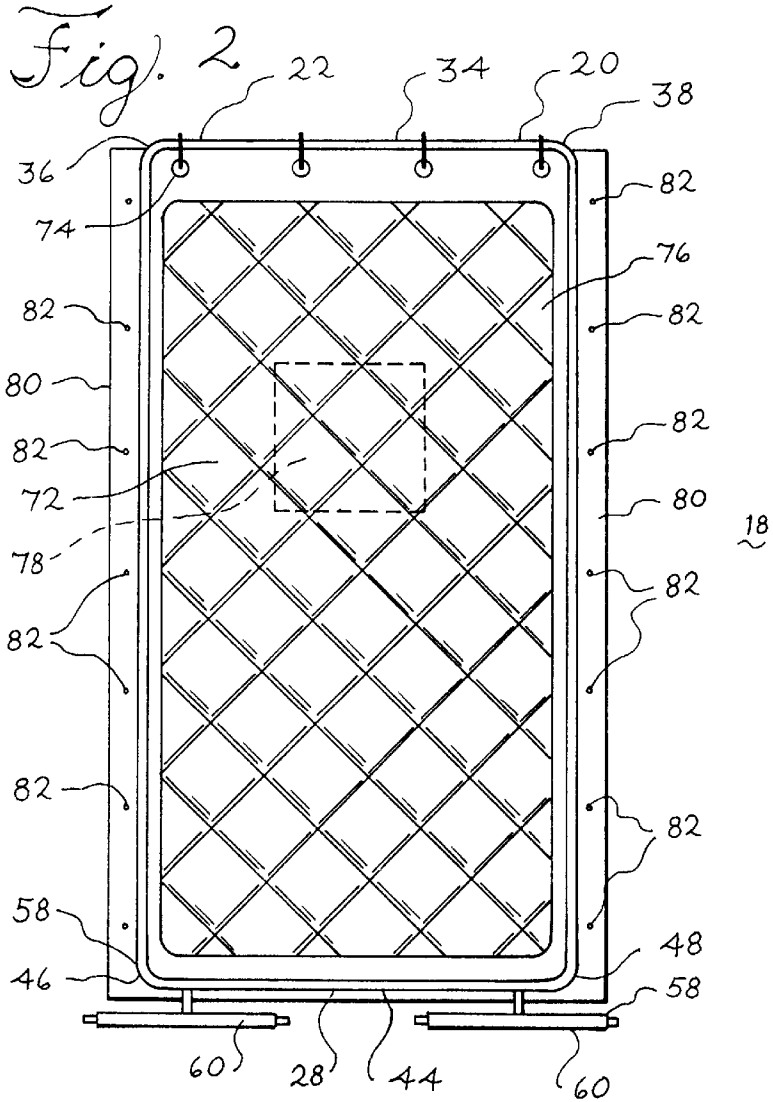
FIG. 2 is a front view of an embodiment of a curtain barrier assembly according to the present invention.

A curtain barrier assembly according to the present invention is schematically shown in FIGS. 1–9, wherein like elements are identified by like numerals. As shown in FIGS. 1–3, the curtain barrier assembly 18 has a steel frame 20 that is made of four tubular sectional pieces: a top frame piece 22, a pair of side frame pieces 24, 26 and a bottom frame piece 28.

The top frame piece 22 is made from a single steel tube bent into a U-shape. The steel tube is hollow and has a circular cross-section having a diameter of approximately one inch. The top frame piece 22 has a pair of legs 30 and 32 that are identical in shape. A top base section 34 is positioned between the legs 30 and 32 and has a length of approximately 48 inches. The legs 30 and 32 are joined to the top base section 34 by elbow portions 36 and 38, respectively, so that the legs 30 and 32 are at right angles to the top base section 34.

As shown in FIGS. 1–3, the bottom frame piece 28 is made in a similar manner as the top frame piece 22. In particular, the bottom frame piece 28 is made from a single steel tube that is bent into a U-shape. The steel tube is hollow and has a circular cross-section having a diameter of approximately one inch. The bottom frame piece 28 has a pair of identically shaped legs 40 and 42. A bottom base section 44 is joined to the legs 40 and 42 by elbow portions 46 and 48, respectively. The bottom base section 44 has a length equal to that of the top base section 34. The legs 40 and 42 are at right angles to the bottom base section 44.

Figure 4:
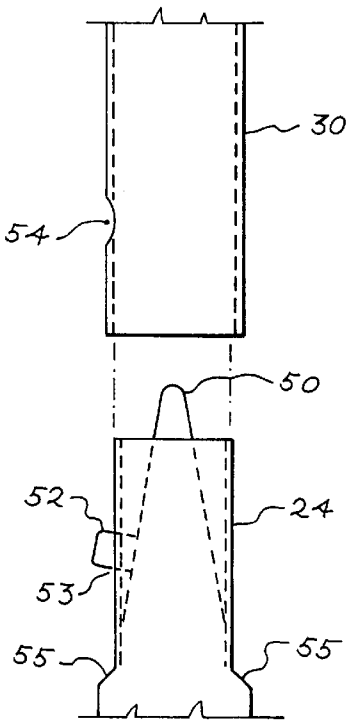
FIG. 4 is an exploded, enlarged view of a side frame piece and a top frame piece of the curtain barrier assembly of FIG. 2 prior to attachment.

The top frame piece 22 and the bottom frame piece 28 are attached to each other by the side frame pieces 24, 26. Each of the side frame pieces 24 and 26 have the same shape and structure. In particular, the side frame pieces 24 and 26 are made from a single steel tube with a circular cross-section having a diameter of approximately one inch. The ends of the side frame pieces are hollow and are tapered so as to have a cross-section that is slightly smaller than that of the legs 30, 32, 40 and 42. At each end of the side frame pieces 24 and 26, male members, such as spring snap latches 50, are inserted so that their appendages 52 are biased and inserted through a side opening 53 formed at the end of the side frame pieces 24, 26 approximately one inch from the end edges thereof. As shown in FIG. 4, each spring snap latch 50 is made of steel and is V-shaped with a total length of approximately 3.75" and a width of approximately 7/16". The appendage 52 is formed approximately 3/8" from an end of the spring snap latch and is generally cylindrical in cross-section having a diameter of approximately 0.25 inches and has a height of approximately 3/8".

With the above described structure, the connection of the left legs 30 and 40 with the left side frame piece 24 will be described below. It is understood that the description to follow is equally applicable to the connection of the right legs 32 and 42 with the right side frame 26. As shown in FIG. 1, the ends of the left side frame piece 24 are telescopically inserted into the ends of the legs 32 and 42 until stop portions, such as shoulders 55, engage the ends of the legs 32 and 42. As shown in FIG. 4, the left side frame piece 24 is generally in the shape of a tube where a first portion has a diameter of approximately one inch and the telescopically received end has a diameter of approximately 7/8", where the shoulder 55 is formed on the exterior surface of the left side frame piece 24 between the first portion and the telescopically received end. During insertion, the appendages 52 of the spring latches 50 will initially be depressed. Once the shoulders 55 are engaged by the ends of the legs 32 and 42, the left side frame piece 24 is rotated until the appendages 52 will snap into the openings 54 and 56 formed at the ends of the legs 32 and 42, respectively, so that the appendages 52 protrude externally from the frame 20, in general, and the legs 32 and 42, in particular. The appendages 52 snap lock the left side frame piece 24 to the left legs 30 and 40. The left side frame piece 24 is disconnected from the legs 32 and 42 by depressing both of the appendages 52 and sliding the left side frame piece 24 out of the ends of the legs 32 and 42.

Note that it is possible to reverse the attachment parts of the top frame piece 22, the left and right side frame pieces 24, 26 and the bottom frame piece 28. For example, the spring snap latches 50 can be inserted into the ends of the top frame piece 22 and the bottom frame piece 28, and the ends of the top and frame pieces 22 and 28 are shaped liked the ends of the side frame pieces so the ends can be telescopically received with the ends of the side frame pieces 24, 26. Attachment would be accomplished in a manner similar to the one described previously.

The assembled frame 20 may be supported on the floor by the bottom receptors 64 alone where in such a case either plastic caps are placed thereon or casters are attached thereto. The frame 20 can be supported on the floor by a pair of identically shaped adjustable feet 58. As shown in FIGS. 1–3 and 5–6, each of the feet 58 have an inverted T-shape with a horizontal base 60 having a length of approximately 24 inches and a vertical stub 62 having a diameter of approximately 7/8" that is located midway on the base 60. The base 60 and the stub 62 are each made of hollow steel tubes that are welded to one another. The ends of the base 60 may have plastic caps placed thereon or casters can be attached thereto.

Figure 5:
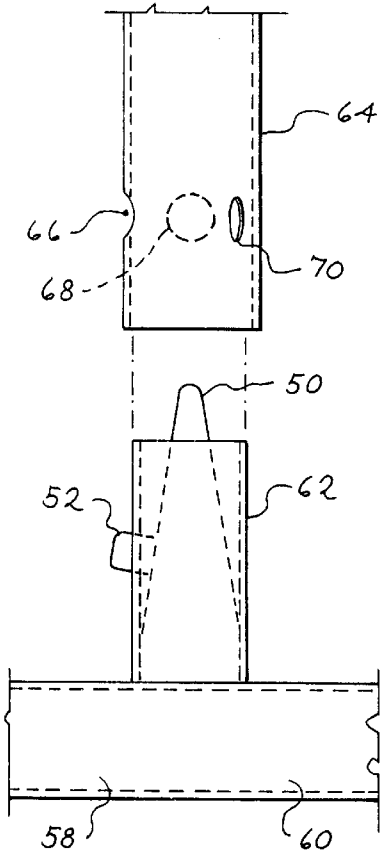
FIG. 5 is an exploded, enlarged view of a foot and a bottom frame piece of the curtain barrier assembly of FIG. 2 prior to attachment.
Figure 7:
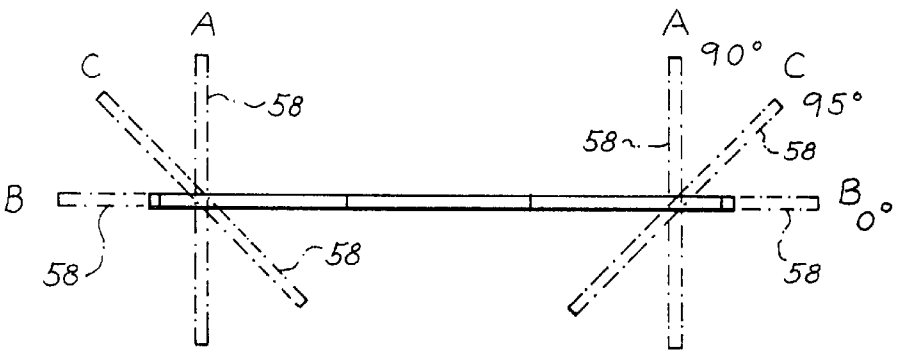
FIG. 7 is a bottom view of the frame of FIG. 1.

As shown in FIG. 5, each of the stubs 62 has a spring latch 50. The feet 58 are attached to the bottom frame piece 28 by inserting the stubs 62 into the pair of bottom tubular receptors 64 that have a diameter of approximately one inch and are integrally attached to the bottom frame piece 28. The bottom receptors 64 have more than two female receptors such as the three openings 66, 68 and 70, that can receive the appendages 52 of the spring latch 50. As shown in FIG. 5, opening 68 is oriented 90° from the opening 66 and 45° from the opening 70. As shown in FIG. 7, the openings allow the spring latches 50, the appendages 52 and the feet 58 to be positioned only at a plurality of predetermined number of orientations equal to the number of female receptors: perpendicular to the bottom frame piece 28 for normal use (A), parallel to the bottom frame piece 28 for storage (B) and angled at 45° with respect to the bottom frame piece 28 for restricted space applications (C). Of course other numbers of openings 70 is possible so as to provide other positions for the feet 58 relative to the frame.

Note that it is possible to reverse the attachment parts of the bottom receptors 64 and the stubs 62. For example, the bottom receptors 64 can have a diameter of approximately 7/8" so as to receive the spring snap latch 50 therein. The bottom receptor 64 would have a single opening to receive the appendage 52. The stubs would have a diameter of approximately one inch and have the three openings 66, 68 and 70. The bottom receptors 64 would be inserted into the stubs and positioned so that the appendage 52 would snap lock into one of the three openings 66, 68 and 70.

Once the frame is assembled, a curtain barrier 72 is attached to the frame 20 by being hung from the frame 20 by one or more "S" hooks 73 being inserted into one or more rolled-rim brass grommets 74 and engaging the top base section 34 of the top frame piece 22 (see FIGS. 2, 3, 8, 9). The curtain barrier 72 is not attached to any of the spring latches 50. The curtain barrier 72 is made of a polyester reinforced vinyl barrier material with a rectangular Sorba-Glas fire-rated absorber material 76 attached thereto in a well known manner. The curtain barrier 72 optionally may have a viewing window 78. The curtain barrier 72 may be used be used as a sound barrier, a welding screen or as a privacy screen. The particular material and structure of the curtain barrier 72 will depend on the particular use of the curtain barrier 72.

Figure 8:
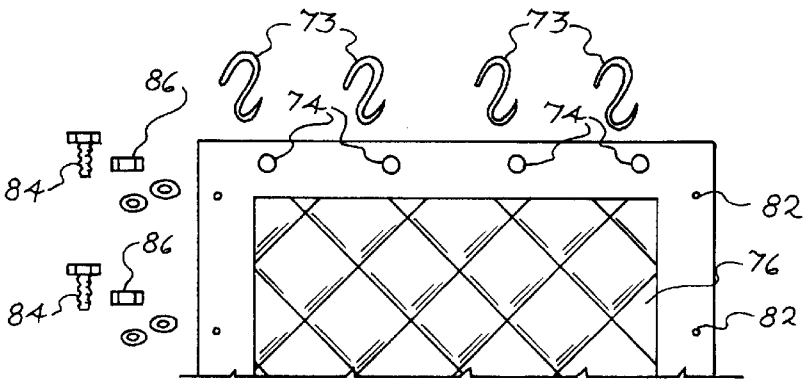
FIG. 8 is a front view of a top portion of a screen to be used with the curtain barrier assembly.
Figure 9:
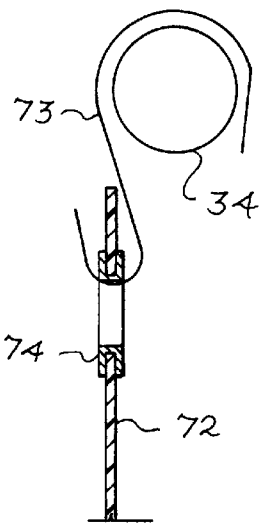
FIG. 9 is a side, cross-sectional view of the attachment of the screen of FIG. 8 to the frame of FIG. 1.
Figure 6:
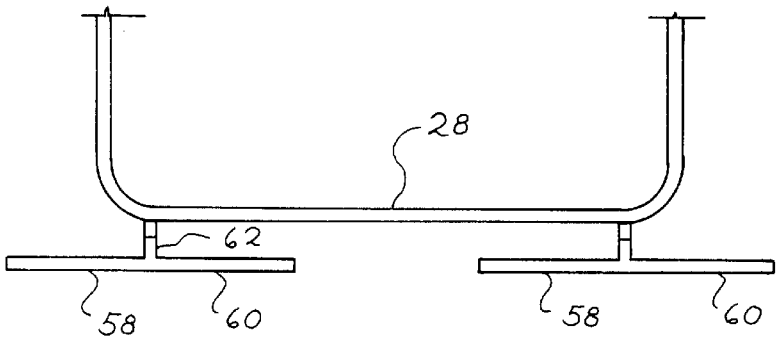
FIG. 6 is a front view of the lower portion of the frame of FIG. 1.

As shown in FIGS. 2, 3 and 8, the curtain barrier 72 is rectangular in shape having a height of approximately 8 feet and a width of approximately 54 inches. The curtain barrier 72 has a width that is greater than the width of the assembled frame 20 so that a pair of side edges 80 extend past the side frame pieces 24, 26 of the frame 20. The side edges 80 have a plurality of openings 82 that are used to attach adjacent curtain barrier assemblies. Attachment of adjacent curtain barrier assemblies is accomplished by aligning the openings 82 of adjacent side edges 80 and inserting bolts 84 through the openings 82 and then attaching nuts 86 to the bolts 84.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than the foregoing description.

I claim:

1. A frame comprising:

a top frame piece;

a bottom frame piece comprising a receptor that comprises at least three female receptors located at corresponding radially spaced predetermined positions;

a first side frame piece attached to said top frame piece and to said bottom frame piece;

a second side frame piece attached to said top frame piece and to said bottom frame piece; and a foot attached to said receptor, wherein said foot comprises a male member that comprises a spring latch with an appendage that can engage one of said at least three female receptors at at any one of said corresponding radially spaced predetermined positions.

2. The frame of claim 1, wherein said foot can be attached to said receptor only at three corresponding radially spaced predetermined positions.

3. The frame of claim 1, wherein each of said at least two female receptors comprises an opening.

4. The frame of claim 1, wherein said foot comprises:

a horizontal base; and a vertical stub that is attached to said receptor.

5. The frame of claim 4, wherein said horizontal base is parallel to said bottom frame piece at one of said at least three corresponding radially spaced predetermined positions.

6. The frame of claim 5, wherein said horizontal base is perpendicular to said bottom frame piece at one of said at least three corresponding radially spaced predetermined positions.

7. The frame of claim 6, wherein said horizontal base lies at an angle of approximately 45 degrees relative to said bottom flame piece at one of said at least three corresponding radially spaced predetermined positions.

8. The frame of claim 5, wherein said horizontal base lies at an angle of approximately 45 degrees relative to said bottom frame piece at one of at least three corresponding radially spaced predetermined positions.

9. The frame of claim 4, wherein said horizontal base is perpendicular to said bottom frame piece at one of said at least three corresponding radially spaced predetermined positions.

10. The frame of claim 9, wherein said horizontal base lies at an angle of approximately 45 degrees relative to said bottom frame piece at one of at least three corresponding radially spaced predetermined positions.

11. The frame of claim 4, wherein said horizontal base lies at an angle of approximately 45 degrees relative to said bottom frame piece at one of said at least three corresponding radially spaced predetermined positions.

12. A curtain barrier assembly comprising:

a frame comprising:

a top frame piece;

a bottom frame piece comprising a receptor that comprises at least three female receptors located at corresponding radially spaced predetermined positions;

a first side frame piece attached to said top frame piece and to said bottom frame piece;

a second side frame piece attached to said top frame piece and to said bottom frame piece; and a foot attached to said receptor, wherein said foot comprises a male member that comprises a spring latch with an appendage that can engage one of said at least three female receptors at at either one of said corresponding radially spaced predetermined positions; and a curtain barrier attached to said frame, wherein said attached curtain barrier is not attached to said male member.

13. The curtain barrier assembly of claim 12, wherein said curtain barrier is hung from said frame by one or more hooks.

14. The curtain barrier assembly of claim 13, wherein said curtain barrier comprises one or more grommets into which said one or more hooks are inserted.

15. The curtain barrier assembly of claim 14, wherein said one or more hooks engages said top frame piece.

16. The curtain barrier assembly of claim 12, wherein said curtain barrier comprises a viewing window.

17. The curtain barrier assembly of claim 12, wherein said curtain barrier comprises a side edge that extends past said first side frame piece and has a plurality of openings.

18. The curtain barrier assembly of claim 17, wherein each of said at least three female receptors comprises an opening.

19. The curtain barrier assembly of claim 12, wherein said foot can be attached to said receptor only at three predetermined positions.

20. The curtain barrier assembly of claim 12, wherein said foot comprises:

a horizontal base; and a vertical stub that is attached to said receptor.

21. The curtain barrier assembly of claim 20, wherein said horizontal base is parallel to said bottom frame piece at one of said at least three corresponding radially spaced predetermined positions.

22. The curtain barrier assembly of claim 21, wherein said horizontal base is perpendicular to said bottom frame piece at one of said at least three corresponding radially spaced predetermined positions.

23. The curtain barrier assembly of claim 22, wherein said horizontal base lies at an angle of approximately 45 degrees relative to said bottom frame piece at one of said at least three corresponding radially spaced predetermined positions.

24. The curtain barrier assembly of claim 21, wherein said horizontal base lies at an angle of approximately 45 degrees relative to said bottom frame piece at one of said at least three corresponding radially spaced predetermined positions.

25. The curtain barrier assembly of claim 20, wherein said horizontal base is perpendicular to said bottom frame piece at one of said at least three corresponding radially spaced predetermined positions.

26. The curtain barrier assembly of claim 25, wherein said horizontal base lies at an angle of approximately 45 degrees relative to said bottom frame piece at one of said a least three corresponding radially spaced predetermined positions.

27. The curtain barrier assembly of claim 20, wherein said horizontal base lies at an angle of approximately 45 degrees relative to said bottom frame piece at one of said at least three corresponding radially spaced predetermined positions.

* * * * *

UNITED STATES PATENT AND TRADEMARK OFFICE

CERTIFICATE OF CORRECTION

PATENT NO. : 6,206,079 B1
DATED : March 27, 2001
INVENTOR(S) : Robert Wayne Selgrad It is certified that error appears in the above-identified patent and that said Letters Patent is hereby corrected as shown below:

Column 5,
Line 47, delete “at” (second occurrence).
Line 52, delete “two” and substitute -- three -- in its place.

Column 6,
Line 13, insert -- said -- before “at least”.
Line 33, insert -- said -- before “at least”.
Line 34, delete “at” (third occurrence).
Line 56, after “three” insert -- corresponding radially spaced --.

Column 7,
Line 13, delete “20” and substitute -- 21 -- in its place.

Column 8,
Line 5, delete “a” and substitute -- at -- in its place.

Signed and Sealed this

Second Day of July, 2002

*Attest:*

*Attesting Officer*

JAMES E. ROGAN
*Director of the United States Patent and Trademark Office*